US005165553A

United States Patent [19]

Benson

[11] Patent Number: 5,165,553

[45] Date of Patent: Nov. 24, 1992

[54] SELF-ADJUSTING SADDLE RACK

[76] Inventor: J. Paul Benson, 201 John Rodes Blvd. #611, Melbourne, Fla. 32934

[21] Appl. No.: 769,714

[22] Filed: Oct. 2, 1991

[51] Int. Cl.[5] ..... A47F 7/00

[52] U.S. Cl. ..... 211/13; 211/175

[58] Field of Search ..... 211/13, 168, 133, 175; 248/371, 176

[56] References Cited

U.S. PATENT DOCUMENTS

| | | | |
|---|---|---|---|
| D. 197,292 | 1/1964 | Holmberg . | |
| D. 221,871 | 9/1971 | Pearce . | |
| D. 277,515 | 2/1985 | Secor . | |
| D. 280,687 | 9/1985 | Baldridge . | |
| D. 284,122 | 6/1986 | Kizen . | |
| D. 295,906 | 5/1988 | Wilson . | |
| 943,454 | 12/1909 | Pecoy | 211/133 X |
| 3,476,255 | 11/1969 | Ciancio | 211/13 |
| 4,432,459 | 2/1984 | Coldren . | |
| 4,541,535 | 9/1985 | Bartholomew . | |
| 4,768,656 | 9/1988 | Hartley | 211/13 |

*Primary Examiner*—Alvin C. Chin-Shue
*Assistant Examiner*—Sarah A. Lechok
*Attorney, Agent, or Firm*—Birch, Stewart, Kolasch & Birch

[57] ABSTRACT

A saddle rack having a pair of mutually inclined seat panels which are pivotally supported by a base structure or stand including of a pair of leg assemblies for clockwise and counter-clockwise rotation. The panels are self-adjusting preferably within a substantially 20° rotational range in a first use or saddle storage mode so as to automatically conform the underside of any saddle positioned thereon. In one embodiment, at least one removable end adapter panel is reversibly positionable on the leg assemblies beneath the seat panels so as to permit the seat panels to rotate inwardly to form a right angled support surface for supporting a saddle in an upside down position during a second use or saddle maintenance position mode. Also the seat panels can be held stationary in a coplanar position in a third use mode by an inversion of the adapter panel to provide a flat table-like work surface for tack and the like equipment. Additionally, the saddle rack is provided with one or more open trays as well as a closed storage compartment beneath the saddle support panels.

14 Claims, 2 Drawing Sheets

SELF-ADJUSTING SADDLE RACK

BACKGROUND OF THE INVENTION

This invention relates generally to structures for supporting an equestrian saddle and more particularly to a saddle rack which automatically adjusts itself to any size or shaped saddle while preventing the deformation of the cushions or padding under the saddle that protects the horse.

In addition to supporting a rider, the purpose of a saddle has always been to protect the back of a horse and to aid the rider in maintaining a balanced seat and permitting him to shift his weight as required. By the middle of the 19th century there were many saddle manufacturers all over the world who were making various styles and types of saddles.

The foundation of every saddle, however, is the tree. Early trees were usually made of beech wood for lightness and were reinforced with steel. Today many trees are made entirely of fiberglass or laminated plywood. The tree must be sufficiently strong to withstand pressure and resist splitting. It is shaped to clear the horse's backbone and to receive the stirrup bars which are set in place and then anchored. It is also shaped to receive the leather and padding to accommodate the rider.

All saddles normally include well padded panels under the tree. These panels act as cushions for the horse's back and are normally divided by a channel above the horse's backbone to insure that the weight of the saddle and rider will rest on the muscle pads on either side of the spine. The cushioned panels require periodic care and maintenance so that they remain smooth and retain their shape in order to conform to the horse's back. This is particularly important for the horse's well being. However, it is often given little attention. It is not uncommon to see a saddle draped over a fence rail, a sawhorse, a detached door, a barrel or even thrown on the ground. This practice is not likely to break the saddle tree, but is can shift and distort the padding and scar the leather padding cover, causing much discomfort to the horse.

As competition has grown in riding, equestrian sports saddles have become highly specialized. They, moreover, have been developed to complement the sport in its various aspects, such as jumping, showing, racing, polo, roping, bronco riding, etc. Developments in saddle making in the past, however, were focused on the rider, such as forward or backward position of the seat, a deep or shallow seat, position of stirrups being long to allow a rider's legs to swing for balance or short to maintain a crouch position, etc. Thus saddle rigging is varied for each style saddle to maintain saddle position and balance on the horse's back.

During the period of adaptations above the tree, changes below the tree have normally been limited to the selective placement of the padding to help prevent chafing or bruising the horse. The saddle has always been an unforgiving, durable, rigid structure and its value to man has been immeasurable, but to the horse it has generally been the source of pain ranging from discernable discomfort to one leading to a crippling injury.

Today, many professional and pleasure riders purchase custom made saddles from saddle makers who will make a wire or plaster mold of the saddle area on the horse's back. This mold is a guide for the saddler to make a saddle which properly fits the horse. Usually considerations are also given to the rider's height, weight, and inseam measurements. No doubt this method of purchase has produced the most satisfactory results. In most cases, however, it is probable that the majority of saddles are obtained as an off the shelf item or are acquired from an acquaintance, the matter of fit being determined by trial and error. Padding is then added to stabilize the saddle on the individual horse. Although pads cannot fully correct any ill fitting saddle, they can certainly improve the fit of almost any saddle and thus should be well cared for.

It is only in the past few years that advancements in saddle making have benefitted the horse as much as the rider. The tree has been made stronger than ever but not as rigid. Moreover, flexibility is built into the support panels on each side of the tree, the theory here being similar to the principle of independent wheel suspension in vehicles. Thus one shields the movement on each side from the opposite side. In modern saddle making, it results from an improved understanding of how a horse's muscular system operates and putting this knowledge to use. The results are that more freedom of movement and less chafing of the horse is achieved and thus a smoother ride for the rider. The newer saddles have become lighter in weight than their predecessors because less padding is required. In endurance competition, they have made the difference between winning or losing and finishing or not finishing a race. Thus it becomes important to keep the leather covering over the padding smooth and free from bumps and hollows, since the saddle fit and the placement and condition of the leather covering the padding greatly affects the behavior of the horse.

While various types of saddle racks are generally known, the most common rack in use today is a folding aluminum pipe type rack. This type of saddle rack is sturdy enough for years of use but the support is devastating to the padding under the saddle. While they are readily available, they require no finish and only minimal assembly. Wooden type racks are also known and are readily available but still leave a lot to be desired insofar as its ability to protect the padding. The usual construction is of a non-conforming fixed saddle holder comprised of raw shelving grade type of white pine located on a stand which is inadequately braced or properly jointed for stability.

While it is possible to obtain a custom made rack for a particular saddle; however, these are limited to those who can afford to have one made or who have the ability to construct their own. Additionally, if the saddle is replaced, the advantage of the custom made rack is lost.

SUMMARY

Accordingly, it is an object of the present invention to provide an improvement in equestrian saddle racks.

It is another object of the invention to provide a saddle rack which is adapted to fit different types of saddles.

It is a further object of the invention to provide a saddle rack which automatically conforms to the underside of all types of saddles.

Still another object of the present invention is to provide a saddle rack which in addition to being able to store a saddle, is capable of being modified to provide two types of work and support surfaces for the care and maintenance of various types of saddles and related tack equipment.

These and other objects are achieved by a saddle rack including a pair of mutually inclined seat panels which are pivotally supported by a base structure comprised of a pair of leg assemblies for clockwise and counter-clockwise rotation. The panels are self-adjusting preferably within a substantially 20° rotational range in a first use or saddle storage mode so as to automatically conform the underside of any saddle positioned thereon. In one embodiment, at least one removable end adapter panel is reversibly positionable on the leg assemblies beneath the seat panels so as to permit the seat panels to rotate inwardly for supporting a saddle in an upside down position during a second use or saddle maintenance position mode. Also the seat panels can be positioned in a third use mode to provide a flat table-like work surface for tack and the like equipment. Additionally, the saddle rack is provided with one or more open storage trays as well as a closed compartment beneath the saddle support panels.

BRIEF DESCRIPTION OF THE DRAWINGS

The following detailed description of the invention will be more readily understood when considered together with the accompanying drawings in which.

DETAILED DESCRIPTION OF THE INVENTION

Figure 1:
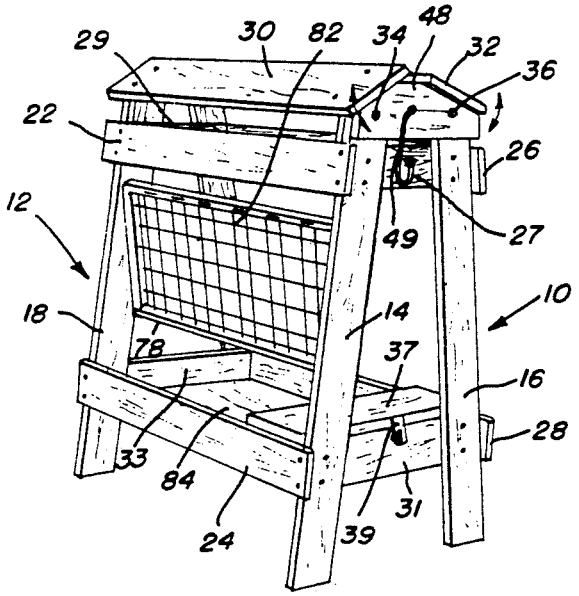
FIG. 1 is a perspective view of a first embodiment of the subject invention and which is particularly useful in connection with English style saddles.

Referring now to the drawings wherein like reference numerals refer to like parts throughout, attention is first directed collectively to FIGS. 1 through 5 wherein there is shown a first embodiment of the invention and which is particularly useful in connection with an English style saddle.

Figure 3:
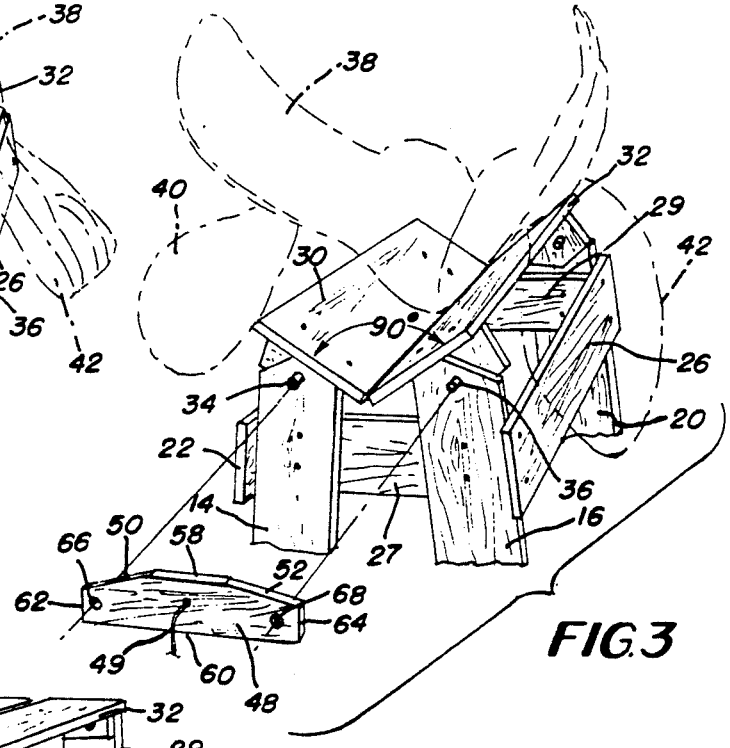
FIG. 3 is a partial exploded perspective view of the embodiment shown in FIG. 1 configured in a second use mode.
Figure 4:
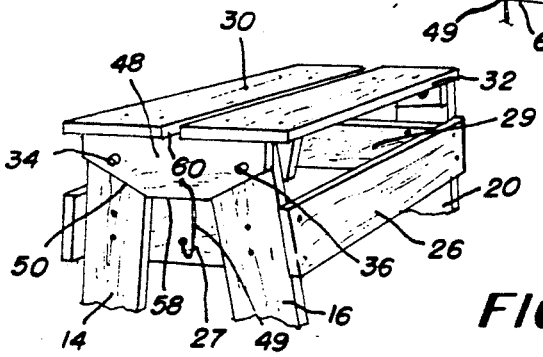
FIG. 4 is a partial perspective view of the embodiment shown in FIG. 1 configured in a third use mode.

As shown in the perspective view of FIG. 1, the saddle rack is comprised of a wooden stand including two pairs of legs 10 and 12 consisting of downwardly extending mutually diverging leg members 14, 16 and 18, 20, the latter member 20 being shown in FIGS. 3 and 4. Upper and lower battens comprising flat board members 22, 24 and 26, 28 extend between the pairs of legs 10 and 12 for providing stability and rigidity. Two relatively short cross brace members 27 and 29 extend between the leg members 14, 16 and 18, 20 at the upper portion thereof.

Figure 5:
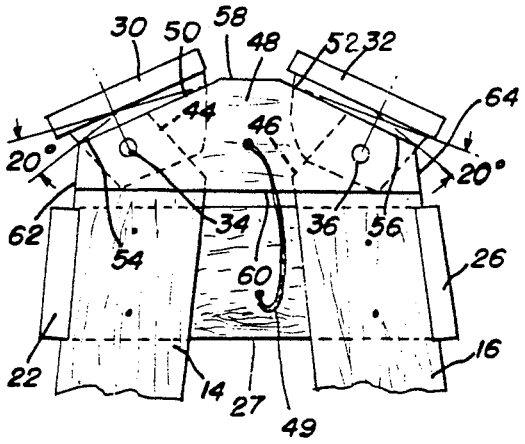
FIG. 5 is a partial end elevational view illustrative of the angular rotational range of the seat panels in the first use mode shown in FIG. 2.

A pair of elongated flat generally rectangular wooden seat panels 30 and 32 comprised of a pair of equal length board members are pivotally mounted on the upper extremities of leg members 14 and 18 and 16 and 20, respectively. Two of the pivots are shown by reference numerals 34 and 36 and may be comprised of dowel pins. The pivots 34 and 36 further define a pair of parallel rotational axes. The seat panels 30 and 32, moreover, are raised slightly above the pairs of legs 10 and 12 so that they can rotate within a 20° range as shown in FIG. 5 so that they will respond immediately clockwise or counter clockwise to the weight of a saddle shown in phantom view in FIG. 2 by reference numeral 38 so that they automatically conform to the padding elements 40 and 42 located on the underside thereof. When desirable, this range can be increased or decreased for an extremely small or large saddle.

Figure 2:
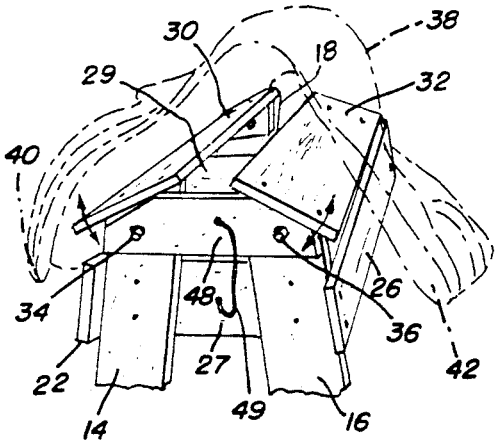
FIG. 2 is a partial end elevational view of the embodiment shown in FIG. 1 configured in a first use mode.

Further as shown in FIG. 5, the upper extremities of the leg members 14, 16 and 18, 20 include beveled inner edges, two of which are shown in FIG. 5 by reference numerals 44 and 46. This permits the panels 30 and 32 to automatically rotate from a storage use mode as shown in FIG. 2, to a maintenance use mode as shown in FIG. 3 when an end adapter panel 48 spanning the dowel pins 34 and 36 is removed. A piece of rawhide or rope 49 is connected between the adapter panel 48 and the cross brace member 27 for securing the adapter panel 48 to the saddle rack even when it is removed and not in use. When rotated inwardly, the panels 30 and 32 come to rest on the inwardly facing beveled edges 44 an 46, providing a V-shaped support surface comprised of a pair of flat surfaces mutually oriented at a substantially 90° angle. Such a configuration can readily accommodate an inverted saddle 38 as shown in FIG. 3 so that the underside of the saddle 38 and the padding 40 and 42 can be cleaned and repaired. When the saddle 38 is in position as shown in FIG. 3, the panels 30 and 32 can furthermore be manually rotated outwardly as desired so that a snug fit between the elements is provided.

The end adapter panel 48 is shown comprising a flat piece of board stock which is cut or otherwise formed to include a pair of mutually inclined outer edges 50 and 52 which extend, for example, the width of the seat panel members 30 and 32 and coincide with the upper outer edges 54 and 56 of the leg members 14 and 16, it being noted that the rear legs 18 and 20 include the same identical shape. The adapter panel 48, moreover, includes an intermediate outer edge 58 between the edges 50 and 52 which is parallel to an opposing elongated linear edge 60. A pair of side edges 62 and 64 conform to the outside edge of the legs 14 and 16 when positioned in the storage mode as shown in FIGS. 2 and 5. Lastly, a pair of mounting holes 66 and 68 are located in the body of the panel 48 which permits the adapter panel 48 to be set into place on the dowel pins 34 and 36.

As shown in FIG. 4, a third use mode is provided by simply inverting the adapter panel 48 from the position as shown in FIG. 2. When this is done, the elongated linear edge 60 now face the seat panels 30 and 32 and provides a surface for the seat panels 30 and 32 to rotate and come to rest as shown and provide a flat work surface which can be used as desired. One known use for the arrangement shown in FIG. 4 is for the assembly and/or maintenance of related tack and the like, not shown.

Figure 6:
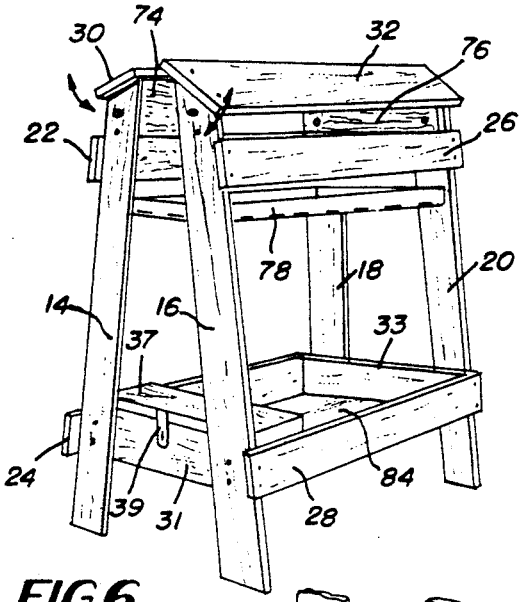
FIG. 6 is a perspective view of a second embodiment of the invention and which is particularly useful in connection with a Western style saddle.
Figure 7:
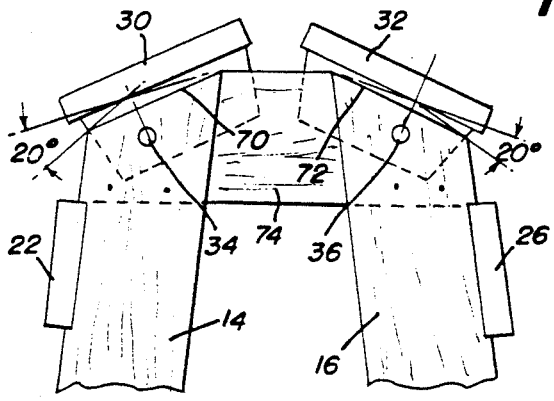
FIG. 7 is a partial end planar view illustrative of the angular rotational range of the seat panels of the second embodiment shown in FIG. 7.

A second embodiment of the invention is shown in FIGS. 6 and 7 and comprises a relatively simpler version of the embodiment considered heretofore and is one which is well suited to accommodate a Western style saddle in that it only includes one use mode, i.e. the storage mode. As shown, the saddle rack is again comprised of a wooden structure which includes two pairs of leg members 14, 16, and 18, 20 which are joined together by upper and lower batten members 22, 24 and 26, 28. As before, a pair of independently rotatable seat panels 30 and 32 are pivotally mounted at the upper ends of the leg members 14, 16, and 18, 20 as before. FIG. 7 shows a pair of dowel pins 34, 36 being used to secure the panels 30 and 32, respectively. Now, however, the upper edges 70 and 72 comprise continuous edges as opposed to that shown in FIG. 5. A pair of cross members 74 and 76 (FIG. 6) shaped like the adapter panel 48, are secured to the upper extremities of the leg members 14, 16 and 18, 20.

It is significant to note, however, that as in the first embodiment, the seat panels 30 and 32 are raised above the upper edges 70 and 72 so as to permit the individual rotation thereof over the range of substantially 20° as before so as to automatically fit the underside of a saddle, not shown, when placed thereon.

Figure 8:
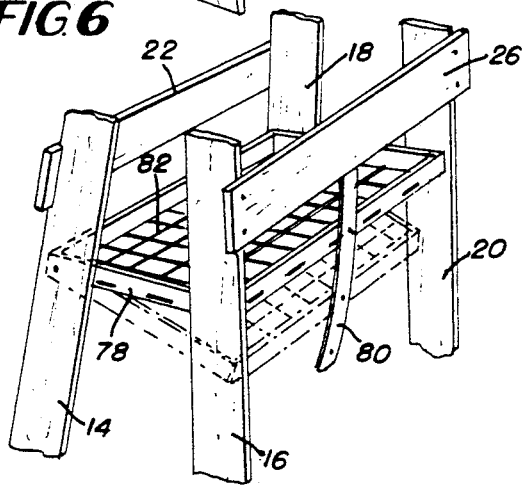
FIG. 8 is a partial perspective view illustrative of an upper ventilated storage tray mounted on the legs of either embodiment shown in FIGS. 1 and 6.

In both embodiments as generally shown in FIGS. 1 and 6, there is additionally provided an open tray 78 which is pivotally mounted, for example, between the upper portions of the leg members 14, 16 and 18, 20 so that it can swing down as shown in FIG. 1, but is held in a generally horizontal orientation by a leather stay or the like 80, which is secured, for example, to the upper batten 26 as shown in FIG. 8. The tray 78 additionally includes an open weave bottom 82 which can be used, for example, for storing and drying wet or damp items associated with riding.

Figure 9:
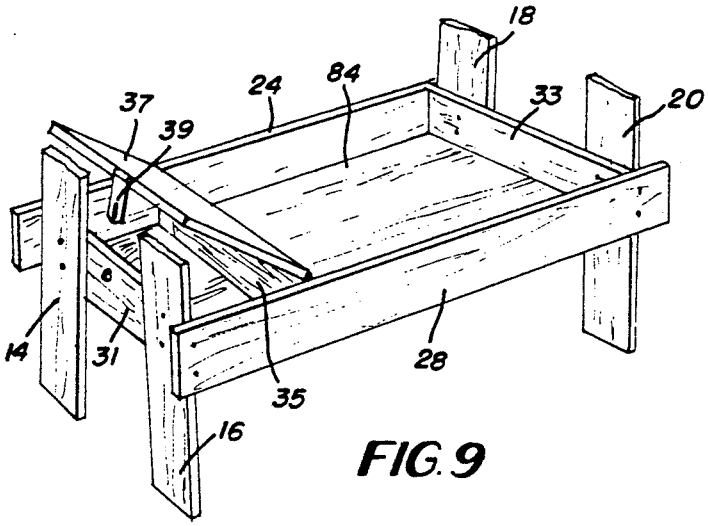
FIG. 9 is a perspective view of a lower tray and closed compartment adjacent thereto located on either of the embodiments shown in FIGS. 1 and 6.

A solid bottom panel 84 is secured between the lower battens 24 and 28 and a pair of cross members 31 and 33. This can provide a tack storage area. To the side of the tack storage area there is also provided a compartment configured from the two side batten members 24 and 28, the cross brace member 31, a rear wall 35 and a hinged lid 37 attached thereto as shown in FIG. 9. With the addition of closure hardware 39, a closable box is provided for placement of valuables and other articles therein.

Thus what has been shown and described is a relatively versatile yet sturdy saddle rack which can be used for both English and Western style saddles. While the embodiments shown are preferably made of wood, it should be noted that other materials such as metal can be utilized when desired. Furthermore, other means can be utilized for effecting the rotational ranges of the panel members as shown in FIGS. 5 and 7 as well as for effecting the other two maintenance and work modes shown in FIGS. 3 and 4, respectively.

Having thus shown and described what is at present considered to be the preferred embodiments of the invention, it should be noted that the same has been made by way of illustration and not limitation. Accordingly, all modifications, alterations and changes coming within the spirit and scope of the invention are herein meant to be included.

I claim:

1. A self-adjusting saddle rack which automatically conforms to the underside of an equestrian saddle, comprising:

a pair of self-rotatable saddle support members, said support members comprising generally flat rectangular seat panel members and being rotatable on mutually parallel longitudinal axes over a predetermined angular range in response to the weight of a saddle in a first use mode; and means for supporting said seat panel members in a predetermined orientation on a top portion thereof, said panel members being tilted mutually outwardly in said first use mode and being rotatable inwardly so as to provide a concave support surface during a second use mode.

2. The saddle rack as defined by claim 1 wherein said panels rotate inwardly so as to provide a V-shaped support surface during said second use mode.

3. The saddle rack as defined by claim 1 wherein said panels rotate inwardly so as to provide a substantially right angled support surface during said second use mode.

4. The saddle rack as defined by claim 1 wherein said panels additionally rotate inwardly to a mutually coplanar position so as to provide a generally flat support surface during a third use mode.

5. The saddle rack as defined by claim 1 and additionally including means for constraining the rotation of said panel members to said predetermined range in said one use mode, for preventing substantially any rotation of said panel members in a third use mode and wherein manipulation of said means for constraining permits inward rotation of said panel member to effect said second use mode.

6. The saddle rack as defined by claim 5 wherein said means for constraining comprises an adapter panel mounted on said means for supporting and being located at one end of said panel members.

7. The saddle rack as defined by claim 6 wherein said adapter panel comprises a reversible mountable panel having a pair of mutually inclined outer edges which are contactable with said panel members in said at least one use mode and a single straight outer edge which is contactable with said panel members in said at least one other use mode.

8. The saddle rack as defined by claim 7 wherein said panel members are mutually tilted and constrained to an angular range of substantially 20° in said one use mode.

9. The saddle rack as defined by claim 5 wherein said panels are mutually coplanar in said third use mode to provide a generally flat support surface.

10. The saddle rack as defined by claim 1 wherein said means for supporting comprises a stand including a pair of leg assemblies located at each end of said panel members.

11. The saddle rack as defined by claim 10 and additionally including pivot means for mounting said panel members on said leg assemblies.

12. The saddle rack as defined by claim 10 and additionally including at least one storage tray located under said panel members between said leg assemblies.

13. The saddle rack as defined by claim 10 and additionally including a closable storage compartment located under said panel members between said leg assemblies.

14. The saddle rack as defined by claim 10 and additionally including upper and lower tray assemblies and a closable storage compartment located under said panel members between said leg assemblies.

* * * * *